US009829014B2

(12) United States Patent
Kleitsch et al.

(10) Patent No.: US 9,829,014 B2
(45) Date of Patent: Nov. 28, 2017

(54) HYDRAULIC SYSTEM INCLUDING INDEPENDENT METERING VALVE WITH FLOWSHARING

(71) Applicant: Caterpillar Inc., Peoria, IL (US)

(72) Inventors: Andrew J. Kleitsch, Shorewood, IL (US); Pengfei Ma, Naperville, IL (US); Jason L. Brinkman, Peoria, IL (US); Mikhail Sorokin, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 394 days.

(21) Appl. No.: 14/696,869

(22) Filed: Apr. 27, 2015

(65) Prior Publication Data

US 2016/0312807 A1 Oct. 27, 2016

(51) Int. Cl.

| | |
|---|---|
| ***F15B 11/16*** | (2006.01) |
| ***F15B 11/00*** | (2006.01) |
| *E02F 9/22* | (2006.01) |

(52) U.S. Cl.

CPC ..... *F15B 11/165* (2013.01); *F15B 11/006* (2013.01); *F15B 11/163* (2013.01); *E02F 9/2228* (2013.01); *F15B 2211/20553* (2013.01); *F15B 2211/20576* (2013.01); *F15B 2211/30535* (2013.01); *F15B 2211/30555* (2013.01); *F15B 2211/30575* (2013.01); *F15B 2211/61* (2013.01); *F15B 2211/6313* (2013.01); *F15B 2211/6316* (2013.01); *F15B 2211/6346* (2013.01); *F15B 2211/6355* (2013.01); *F15B 2211/6652* (2013.01); *F15B 2211/6654* (2013.01); *F15B 2211/7142* (2013.01)

(58) Field of Classification Search

CPC ..... F15B 11/161; F15B 11/163; F15B 11/165; E02F 9/2225; E02F 9/2228

USPC ..... 60/420, 422

See application file for complete search history.

(56) References Cited

U.S. PATENT DOCUMENTS

| | | | | |
|---|---|---|---|---|
| 6,880,332 | B2 * | 4/2005 | Pfaff | F15B 11/006 60/422 |
| 7,251,935 | B2 * | 8/2007 | Zhang | F15B 11/006 91/454 |
| 7,814,749 | B2 | 10/2010 | Cadman et al. | |
| 7,921,878 | B2 | 4/2011 | Coolidge | |
| 8,899,143 | B2 * | 12/2014 | Ho | E02F 9/2214 91/451 |
| 2008/0238187 | A1 | 10/2008 | Garnett et al. | |

(Continued)

*Primary Examiner* — Michael Leslie

(57) ABSTRACT

An independent metering valve circuit includes an actuator, a set of independent metering valves, an independent metering valve pre-compensator, an inverse resolver, and a signal conditioning element. The set of independent metering valves are fluidly coupled to the actuator and configured to independently control a flow of a hydraulic fluid to the actuator. The independent metering valve pre-compensator is configured to control the flow of the hydraulic fluid to the set of independent metering valves. The inverse resolver is configured to receive a first pressure signal from the independent metering valve circuit and a second pressure signal from a load-sense hydraulic system and output a third pressure signal. The signal conditioning element is configured to receive the third pressure signal and output a forth pressure signal configured to control a pump fluidly coupled to the load-sense hydraulic system and the independent metering valve circuit.

20 Claims, 6 Drawing Sheets

(56) References Cited

U.S. PATENT DOCUMENTS

| | | | | |
|---|---|---|---|---|
| 2009/0025380 | A1 | 1/2009 | Harsia | |
| 2013/0098459 | A1 * | 4/2013 | Opdenbosch | F17D 1/20 137/2 |
| 2013/0112297 | A1 | 5/2013 | Jadhav et al. | |
| 2014/0093397 | A1 | 4/2014 | Engelbrecht et al. | |

* cited by examiner

HYDRAULIC SYSTEM INCLUDING INDEPENDENT METERING VALVE WITH FLOWSHARING

TECHNICAL FIELD

The present disclosure relates generally to hydraulic systems and, more particularly, to a hydraulic system including flowsharing between one or more independent metering valves.

BACKGROUND

Hydraulic systems are known for converting fluid power, for example, pressurized flow, into mechanical power. Fluid power may be transferred from one or more hydraulic pumps through fluid conduits to one or more hydraulic actuators. Hydraulic actuators may include hydraulic motors that convert fluid power into shaft rotational power, hydraulic cylinders that convert fluid power into translational power, or other hydraulic actuators known in the art.

In an open-loop hydraulic system, fluid discharged from an actuator is directed to a low-pressure reservoir, from which the pump draws fluid. Controlling an operation of a hydraulic actuator in a hydraulic circuit is conventionally accomplished using a single spool-type valve. The single spool valve has a series of metering slots which control flows of hydraulic fluid in the hydraulic circuit, including a flow from a pump to the hydraulic actuator and a flow from the hydraulic actuator to a tank. When the hydraulic actuator is a hydraulic cylinder, these flows are commonly referred to as pump-to-cylinder flow and cylinder-to-tank flow, respectively.

The metering slots may be machined into the stem of the spool valve. With this arrangement, slot timing and modulation are fixed. Thus, in order to modify the performance of a hydraulic circuit including such a spool valve, the stem may require additional machining. Furthermore, in order to add additional features to the performance of the hydraulic circuit, an entirely new stem may be required. In turn, adding features to or optimizing the performance of conventional hydraulic circuits may be expensive and time consuming.

Hydraulic systems with independent metering valves (IMVs) provide an operator with the ability to modify the performance of the hydraulic circuit without modifying hardware. In a hydraulic system with IMVs, each IMV includes four independently operable, electronically controlled metering valves to control flows within the hydraulic circuit. Two of the metering valves are disposed between the input port and the control ports. The other two metering valves are disposed between the output port and the control ports. Because each of the metering valves is controlled electronically, the performance of the hydraulic circuit can be modified by adjusting a control signal to one or more of the metering valves.

U.S. Pat. No. 6,880,332 (hereinafter "the '332 publication"), titled "Method of Selecting a Hydraulic Metering Mode for a Function of a Velocity Based Control System," purports to describe a hydraulic system with an IMV in which the metering modes can be varied according to the task. However, while the '332 publication offers certain advantages over conventional spool-type valves, the hydraulic system of the '332 publication include particular electrohydraulic (EH) control systems that are not present in conventional hydraulic systems. As a result, the hydraulic system of the '332 publication may be incompatible with conventional hydraulic systems incorporating spool-type valves.

Accordingly, there is a need for improved hydraulic systems to address the problems described above and/or problems posed by other conventional approaches.

SUMMARY

In one aspect, a hydraulic system includes a first pump, a variable flow controller, a load-sense circuit, an independent metering valve circuit, an inverse resolver, and a signal conditioning element. The first pump is configured to generate a flow of a hydraulic fluid. The variable flow controller is configured to control a flow rate of the first pump in response to a first pressure signal. The load-sense circuit is fluidly coupled to the first pump. The load-sense circuit includes a first actuator and a first control valve. The first control valve is fluidly coupled to the first actuator and configured to control the flow of the hydraulic fluid to the first actuator. The first control valve has a signal port fluidly coupled to the variable flow controller and is configured to generate a second pressure signal. The independent metering valve circuit is fluidly coupled to the first pump and is configured to generate a third pressure signal. The independent metering valve circuit includes a second actuator, a set of independent metering valves, and an independent metering valve pre-compensator. The set of independent metering valves are fluidly coupled to the second actuator and are configured to independently control the flow of the hydraulic fluid to the second actuator. The independent metering valve pre-compensator is configured to control the flow of the hydraulic fluid to the set of independent metering valves. The inverse resolver is configured to receive the second pressure signal and the third pressure signal and output a fourth pressure signal. The signal conditioning element is configured to receive the fourth pressure signal and output the first pressure signal.

In another aspect, an independent metering valve circuit includes an actuator, a set of independent metering valves, an independent metering valve pre-compensator, an inverse resolver, and a signal conditioning element. The set of independent metering valves are fluidly coupled to the actuator and configured to independently control a flow of a hydraulic fluid to the actuator. The independent metering valve pre-compensator is configured to control the flow of the hydraulic fluid to the set of independent metering valves. The inverse resolver is configured to receive a first pressure signal from the independent metering valve circuit and a second pressure signal from a load-sense hydraulic system and output a third pressure signal. The signal conditioning element is configured to receive the third pressure signal and output a forth pressure signal configured to control a pump fluidly coupled to the load-sense hydraulic system and the independent metering valve circuit.

In yet another aspect, the disclosure describes a method of integrating an independent metering valve circuit in a load-sense hydraulic system. In this method, an inverse resolver, a signal conditioning element, and independent metering valve circuit are installed in the load-sense hydraulic system. The inverse resolver is configured to receiving a first pressure signal from an independent metering valve circuit and a second pressure signal from a load-sense hydraulic system and outputting a third pressure signal. The signal conditioning element is configured to receiving the third pressure signal from the inverse resolver and outputting a forth pressure signal configured to control a pump fluidly coupled to the load-sense hydraulic system and the independent metering valve circuit. The independent metering valve circuit includes an actuator, a set of independent metering valves, and an independent metering valve pre-compensator. The set of independent metering valves are fluidly coupled to the actuator and configured to independently control a flow of a hydraulic fluid to the actuator. The independent metering valve pre-compensator is configured to control the flow of the hydraulic fluid to the set of independent metering valves.

It is to be understood that the disclosure is not limited in its application to the details of construction and to the arrangements of the components set forth in the following description or illustrated in the drawings. The disclosed device and method are capable of aspects in addition to those described and of being practiced and carried out in various ways. Also, it is to be understood that the terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the various aspects. It is important, therefore, that the claims be regarded as including such equivalent constructions insofar as they do not depart from the spirit and scope of the various aspects.

The drawings presented are intended solely for the purpose of illustration and therefore, are neither desired nor intended to limit the subject matter of the disclosure to any or all of the exact details of construction shown, except insofar as they may be deemed essential to the claims.

DETAILED DESCRIPTION

Figure 1:
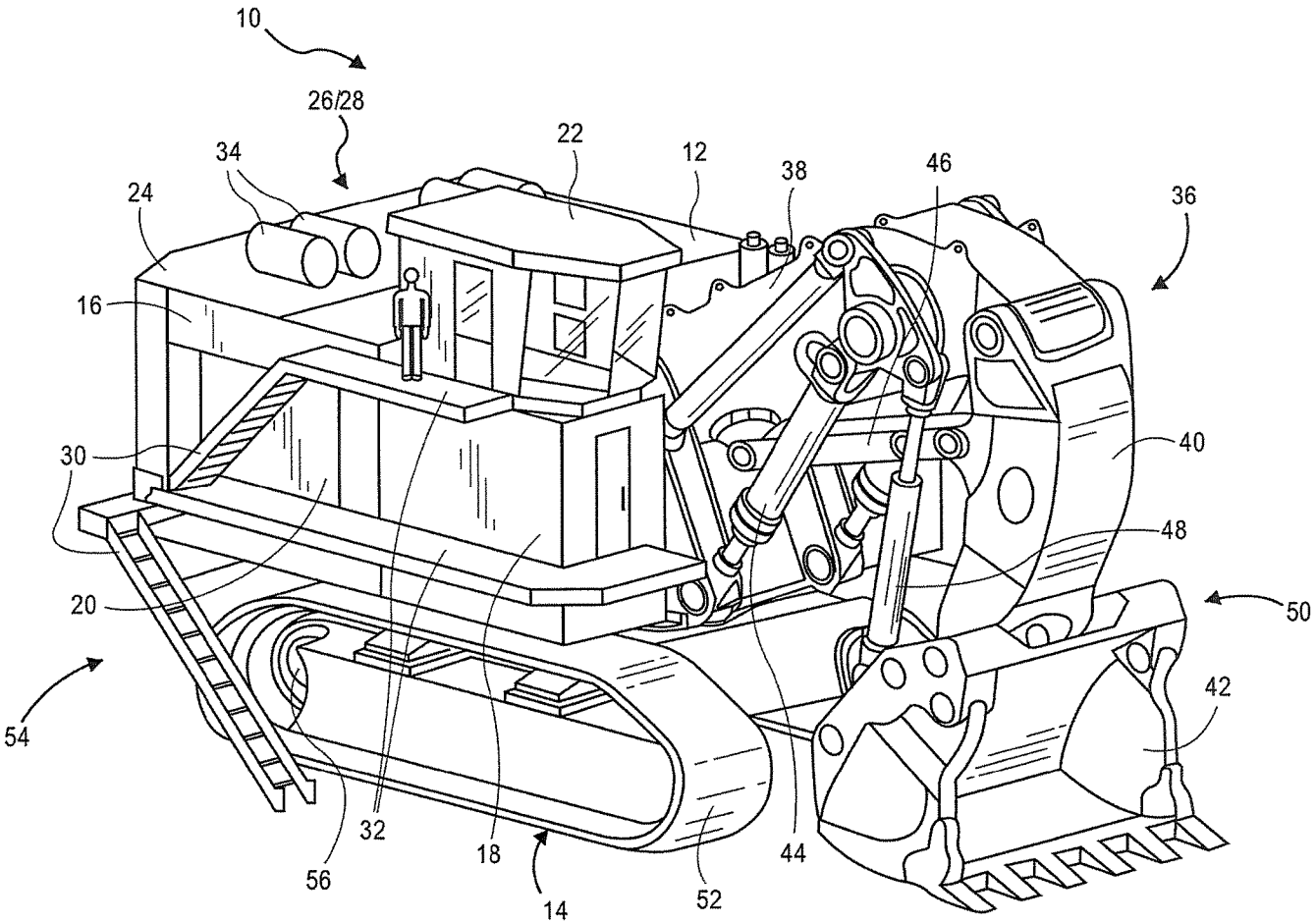
FIG. 1 illustrates an exemplary machine, according to an aspect of the disclosure.

FIG. 1 illustrates an exemplary machine 10 having various systems and components that cooperate to accomplish a task. The machine 10 may embody a fixed or mobile machine that performs some type of operation associated with an industry such as mining, construction, farming, transportation, or another industry known in the art. For example, the machine 10 may be an earth moving machine such as an excavator or a power shovel, a dozer, a loader, a backhoe, a motor grader, a dump truck, or another earth moving machine.

Referring to FIG. 1, the machine 10 may include heavy equipment in the form of a power shovel that includes a deck 12 moveable upon a drive system 14. The deck 12 further includes a powerhouse 16, an electronic compartment 18 (e.g., e-house), a hydraulic system 20, an operator cab or operator station 22, energy storage components 24, a power source 26, and hydraulic cooling systems 28. Various stairwells 30 and walkways 32 may be incorporated with the deck 12 for operator movement throughout the machine 10. Exhaust mufflers 34 are positioned on the deck 12 above the powerhouse 16 and to the rear of the operator station 22. Extending from the deck 12, the machine 10 further includes an articulated arm or implement system 36 including a boom 38 rotatably coupled to an arm 40 (e.g., a stick), which is rotatably coupled to a work tool 42.

According to an exemplary aspect of the disclosure, actuators (e.g., linear actuators) in the form of hydraulic cylinders, control the movements of the various components of the implement system 36. For example, a boom hydraulic cylinder 44 extends between the deck 12 and the boom 38 to control movement of the boom 38 relative to the deck 12. In addition, an arm hydraulic cylinder 46 extends between the boom 38 and the arm 40 to control movement of the arm 40 relative to the boom 38. A curl hydraulic cylinder 48 extends between the boom 38 and the work tool 42 to control movement of the work tool 42 relative to the arm 40. According to an exemplary aspect of the disclosure, the hydraulic cylinders 44, 46, 48 are double-acting cylinders, configured to receive hydraulic fluid on both ends of the respective pistons. Additional actuators (e.g., electric or hydraulic motors) may be used to propel the machine 10 via the drive system 14, and/or to rotate the deck 12 relative to the drive system 14.

Numerous different work tools 42 may be attached to the machine 10 and controlled by an operator. The work tool 42 may include any device used to perform a particular task such as, for example, a bucket (shown in FIG. 1), a fork arrangement, a blade, a shovel, a ripper, a dump bed, a broom, a snow blower, a propelling device, a cutting device, a grasping device, or any other task-performing device known in the art. Although the aspect illustrated in FIG. 1 shows the work tool 42 configured to pivot in the vertical direction relative to the body 23 and to swing in the horizontal direction about a pivot axis, it will be appreciated that the work tool 42 may alternatively or additionally rotate relative to the implement system 36, slide, open and close, or move in any other manner known in the art.

The drive system 14 may include one or more traction devices powered to propel the machine 10. As illustrated in FIG. 1, the drive system 14 may include a left track 50 located on one side of the machine 10, and a right track 52 located on an opposing side of the machine 10. The left track 50 may be driven by a left travel motor 54, and the right track 52 may be driven by a right travel motor 56. It is contemplated that the drive system 14 could alternatively include traction devices other than tracks, such as wheels, belts, or other known traction devices. The machine 10 may be steered by generating a speed and/or rotational direction difference between the left travel motor 54 and the right travel motor 56, while straight travel may be effected by generating substantially equal output speeds and rotational directions of the left travel motor 54 and the right travel motor 56.

The power source 26 may include a combustion engine such as, for example, a reciprocating compression ignition engine, a reciprocating spark ignition engine, a combustion turbine, or another type of combustion engine known in the art. It is contemplated that the power source 26 may alternatively include a non-combustion source of power such as a fuel cell, a power storage device, or another power source known in the art. The power source 26 may produce a mechanical or electrical power output that may then be converted to hydraulic power for moving the actuators of the implement system 36.

The operator station 22 may include devices that receive input from an operator indicative of desired maneuvering. Specifically, the operator station 22 may include one or more operator interface devices 58 (shown in FIG. 4), for example a joystick, a steering wheel, or a pedal, that are located near an operator seat (not shown). Operator interface devices may initiate movement of the machine 10, for example travel and/or tool movement, by producing displacement signals that are indicative of desired machine 10 maneuvering. As an operator moves the operator interface device 58, the operator may affect a corresponding machine 10 movement in a desired direction, with a desired speed, and/or with a desired force.

Figure 2:
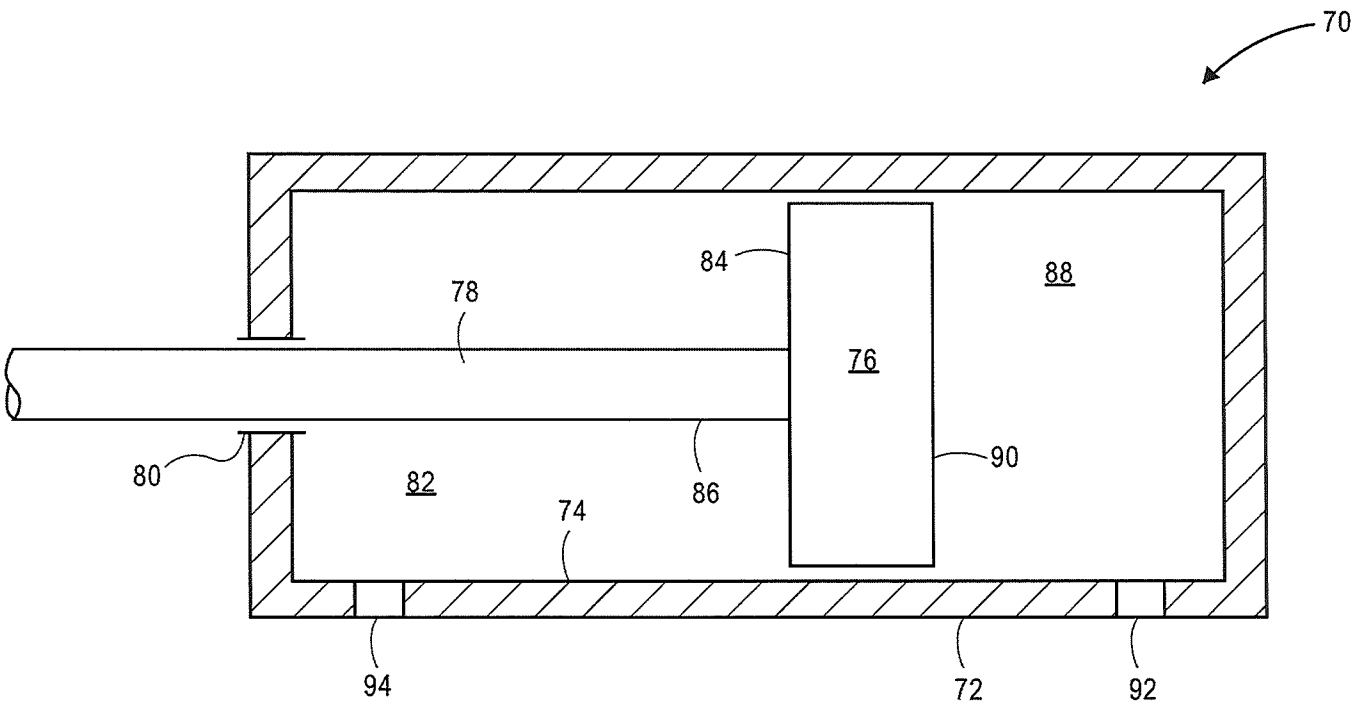
FIG. 2 shows a schematic view of a linear hydraulic cylinder, according to an aspect of the disclosure.

FIG. 2 shows a schematic view of a linear hydraulic cylinder 70, according to an aspect of the disclosure. The linear hydraulic cylinder 70 may include a tube 72 defining a cylinder bore 74 therein, and a piston assembly 76 disposed within the cylinder bore 74. A rod 78 is coupled to the piston assembly 76 and extends through the tube 72 at a seal 80. A rod-end chamber 82 is defined by a first face 84 of the piston, the cylinder bore 74, and a surface 86 of the rod 78. A head-end chamber 88 is defined by a second face 90 of the piston and the cylinder bore 74.

The head-end chamber 88 and the rod-end chamber 82 of the linear hydraulic actuator 70 may be selectively supplied with pressurized fluid or drained of fluid via the head-end port 92 and the rod-end port 94, respectively, to cause piston assembly 76 to translate within tube 72, thereby changing the effective length of the actuator to move work tool 42, for example. A flow rate of fluid into and out of the head-end chamber 88 and the rod-end chamber 82 may relate to a translational velocity of the actuator, while a pressure differential and/or an area differential between the head-end chamber 88 and the rod-end chamber 82 may relate to a force imparted by the actuator on the work tool 42. It will be appreciated that any of the boom hydraulic cylinders 44, the arm hydraulic cylinder 46, or the curl hydraulic cylinder 48, shown in FIG. 1, may embody structural features of the linear hydraulic actuator 70 illustrated in FIG. 2.

A rotary actuator may include first and second chambers located to either side of a fluid work-extracting mechanism such as an impeller, plunger, or series of pistons. When the first chamber is filled with pressurized fluid and the second chamber is simultaneously drained of fluid, the fluid work-extracting mechanism may be urged to rotate in a first direction by a pressure differential across the first and second chambers of the rotary actuator. Conversely, when the first chamber is drained of fluid and the second chamber is simultaneously filled with pressurized fluid, the fluid work-extracting mechanism may be urged to rotate in an opposite direction by the pressure differential. The flow rate of fluid into and out of the first and second chambers may be determined by a rotational velocity of the actuator, while a magnitude of the pressure differential across the pumping mechanism may determine an output torque. It will be appreciated that any of the hydraulic swing motor 60, the left travel motor 54, or the right travel motor 56, illustrated in FIG. 1, may embody the rotary actuator structure described above. Further, it will be appreciated that rotary actuators may have a fixed displacement or a variable displacement, as desired.

Figure 3:
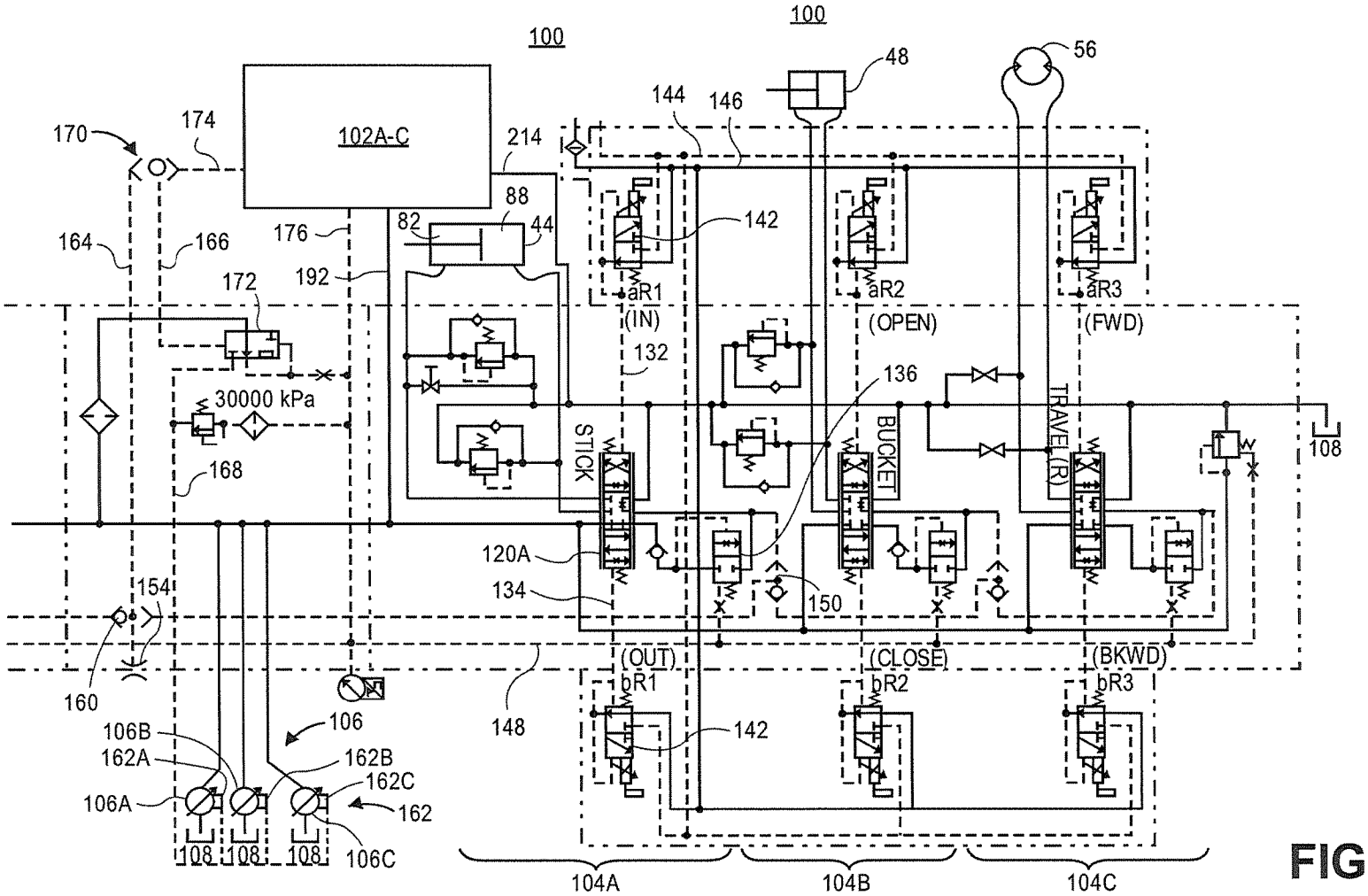
FIG. 3 shows a schematic view of a hydraulic system with load-sense that has been modified according to an aspect of the disclosure.

FIG. 3 shows a schematic view of a hydraulic system 100 with load-sense that has been modified according to an aspect of the disclosure. In general, the hydraulic system 100 has been modified to accommodate flowsharing with an independent metering valve (IMV) circuit 102A-C respectively, shown individually in FIGS. 4-6 and collectively referred to as IMV circuit 102. For the purpose of this disclosure, the terms "flowshare" and "flowsharing" refer to a hydraulic system having hydraulic circuits that are configured to share one or more supplies of hydraulic pressure.

As shown in FIG. 3, the hydraulic system 100 includes a plurality of load-sense circuits 104A-C that each receives a flow of hydraulic fluid from one or more pumps 106A-106C (collectively referred to as the pump 106) and returns the flow of hydraulic fluid to a tank 108. As is generally known, each load-sense circuit of the plurality of load-sense circuits 104A-C is utilized to perform an operation on the machine 10. For example, the load-sense circuit 104A may control the actuation of the boom hydraulic cylinder 44, the load-sense circuit 104B may control the actuation of the curl hydraulic cylinder 48, and the load-sense circuit 104C may control the actuation of the right travel motor 56. In addition, to the load-sense circuits 104A-104C, the hydraulic system 100 may include any suitable number of additional load-sense circuits for actuation of the various additional actuators of the machine 10. For example, the load-sense circuits 104A-104C may represent one wing, or about one half, of the hydraulic system 100. For the sake of brevity, the following description of load-sense circuit 104A will serve to describe the components and operations of the load-sense circuits 104B and 104C.

The load-sense circuit 104A includes a control valve 120A configured to control the flow of hydraulic fluid to and from the boom hydraulic cylinder 44 in response to control signals from the operator interface device 58 (shown in FIG. 4) and load-sense pressure signals 132 and 134. Optionally, the control valve 120A is further modulated by a post-compensation valve 136. To generate the load-sense pressure signals, the load-sense circuit 104A includes a pair of load-sense elements 140 and 142 that are configured to receive a load-sense signal pressure 144 and a supply of hydraulic fluid 146 and output the load-sense pressure signals 132 and 134 (respectively) based on the pressure of the load-sense signal pressure 144.

Optionally, the load-sense circuit 104A includes the post-compensation valve 136 configured to modulate the flow of hydraulic fluid through the control valve 120A in response to a load-sense pressure 148. If included, as is generally understood, the post-compensation valve 136 is configured to maintain a constant pressure drop across the control valve 120A regardless of the load induced pressure on the boom hydraulic cylinder 44.

The load-sense circuit 104A may further include a resolver 150 configured to receive the induced load pressure from the control valve 120A and the highest induced load pressure from the downstream circuits (load-sense circuits 104B and 104C) and output the highest load pressure to a system resolver 160. Prior to integrating the IMV circuit 102 into the hydraulic system 100, the system resolver 160 was configured to output the highest induced load pressure to one or more variable flow controllers 162A-162C (collectively referred to as the variable flow controller 162). The variable flow controller 162 is a pressure responsive controller configured to control the output of the pump 106. In a particular example, the variable flow controller 162 is configured to de-stroke or otherwise control the displacement of the pump 106 via a swashplate actuator. However, the variable flow controller 162 may include any suitable controller capable of modulating the output of the pump 106. In this manner, the pump 106 is operable to supply sufficient flow for the highest induced pressure circuit of the load-sense circuits 104A-104C. However, to integrate the IMV circuit 102 into the hydraulic system 100, an inverse resolver 170 and a signal conditioning element 172 are added to the hydraulic system 100. A load-sense outlet conduit 174 provides the induced pressure from the IMV circuit 102 to the inverse resolver 170 and the inverse resolver 170 is configured to resolve the induced load pressure between the IMV circuit 102 and the load-sense circuits 104A-104C and output the lowest induced pressure to the signal conditioning element 172. The signal conditioning element 172 is configured to receive the pressure signal from the inverse resolver 170 and output a signal pressure suitable to control the variable flow controller 162 via a load-sense supply conduit 176. The signal conditioning element 172 is also configured to output the load-sense pressure 148 that serves to signal the post-compensation valve 136 and serves as the load-sense signal for the IMV circuit 102.

Figure 4:
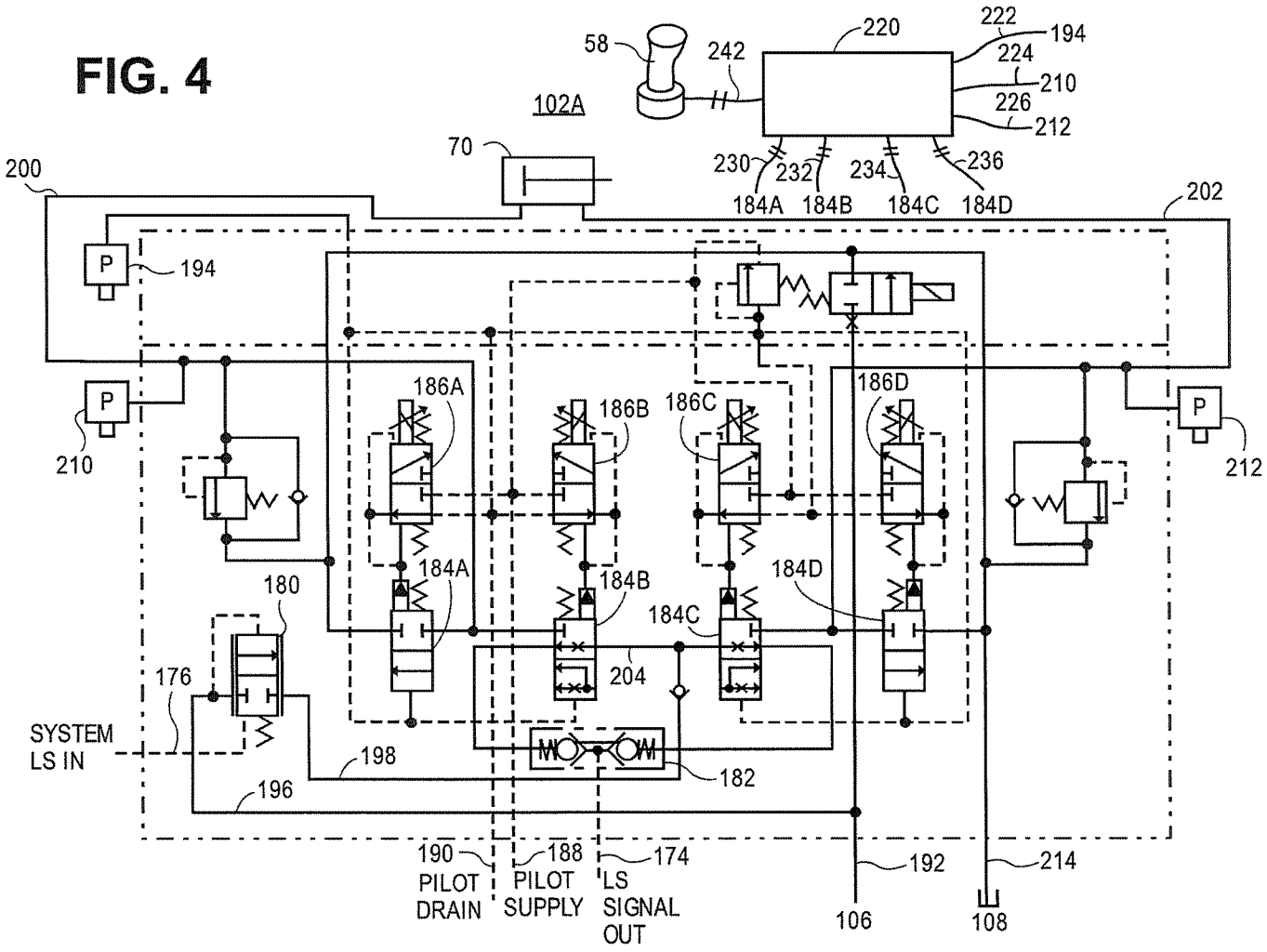
FIG. 4 shows a schematic view of an independent metering valve (IMV) circuit, according to an aspect of the disclosure.

FIG. 4 shows a schematic view of the IMV circuit 102A, according to an aspect of the disclosure. In this example, the IMV circuit 102A is suitable for flowsharing with a load-sense hydraulic system with pre-compensation as shown in FIG. 3. As shown in FIG. 4, the IMV circuit 102A includes an IMV pre-compensator 180, an IMV resolver 182, a set of four, operator-controlled, independent metering valves 184A-184D, a set of four, pilot-operated, proportional valves 186A-186D, and the linear hydraulic cylinder 70. It will be appreciated that any suitable hydraulic actuator may be substituted for the linear hydraulic cylinder 70 in the IMV circuit 102A. A pilot supply conduit 188 provides a pilot signal pressure to the proportional valves 186A-186D and a pilot drain conduit 190 conveys the flow of pilot signal oil away from the IMV circuit 102A.

The IMV pre-compensator 180 is configured to receive the load-sense pressure from the signal conditioning element 172 (Shown in FIG. 3) via the load-sense supply conduit 176 and modulate the flow of hydraulic fluid from the pump 106 in response to the load-sense pressure. The IMV circuit 102A includes a supply of hydraulic fluid from the pump 106 shown in FIG. 3. The flow of hydraulic fluid is supplied via a supply conduit 192 for supplying a hydraulic fluid within the IMV circuit 102A. Optionally, the IMV circuit 102A may include a pressure sensor 194 that is connected to the pilot drain conduit 190 to sense the pressure within the pilot drain conduit 190.

The supply conduit 192 is connected to the IMV pre-compensator 180 via a supply conduit 196. A supply conduit 198 then connects the IMV pre-compensator 180 to a supply conduit 204 that, in turn, is connected to the pair of electronically-actuated independent metering valves 184B and 184C.

The independent metering valves 184A and 184B are connected by a first actuator conduit or head end actuator conduit 200 to the bi-directional linear hydraulic cylinder 70. The linear hydraulic cylinder 70 is also connected to the independent metering valves 184C and 184D by a second actuator conduit or rod end actuator conduit 202. A pressure sensor 210 is shown connected to the head end actuator conduit 200 to sense the pressure in the head end actuator conduit 200. Another pressure sensor 212 is connected to the rod end actuator conduit 202 for sensing the pressure in the rod end actuator conduit 202. Another conduit such as an output conduit 214 connects the independent metering valves 184A and 184D to the tank 108.

The IMV circuit 102A further includes a flow control module 220, such as a microprocessor, which is used to control operation of the IMV circuit 102A. The flow control module 220 may be connected to the pressure sensors 194, 210, and 212 by electrical leads 222, 224, and 226, respectively. The flow control module 220 is capable of receiving signals from the pressure sensors 194, 210, and 212 over the electrical leads 222, 224, and 226 to determine the pressure in the supply conduit 192 and the head end actuator conduit 200 and the rod end actuator conduit 202.

The independent metering valves 184A, 184B, 184C, and 184D are connected to the flow control module 220 via electrical connections 230, 232, 234, and 236, respectively. The flow control module 220 is capable of sending command signals over the electrical connections 230, 232, 234, and 236 to control operation of the independent metering valves 184A, 184B, 184C, and 184D. The flow control module 220 also includes an operator interface device 58 connected to the flow control module 220 by a wire 242. The operator interface device 58 may include such devices as an operator lever, pedal, joystick, keypad, or a keyboard for inputting information such as the speed required of the linear hydraulic cylinder 70. The operator interface device 58 is also capable of providing an input signal or command to the flow control module 220 over the wire 242. Typically, input signal from the operator interface device 58 is a velocity command signal. That is, the operator in the operator station 22 manipulates the operator interface device 58 to achieve a velocity of a selected implement.

The flow control module 220 is capable of receiving signals from the operator interface device 58 and pressure sensors 194, 210, and 212 and/or other suitable sensors. Based upon these signals the flow control module 220 is able to control operation of the independent metering valves 184A, 184B, 184C, and 184D and, optionally, the pump 106. In some particular examples of control sequences, the independent metering valves 184B and 184D may be initially opened and the independent metering valves 184A and 184C are initially closed. Extension of the linear hydraulic cylinder 70 occurs when the independent metering valves 184B and 184D are opened and the independent metering valves 184A and 184C are closed.

Depending upon the pressures sensed by the pressure sensors 194, 210, and 212, the independent metering valve 184C may be opened to restrict the flow of hydraulic fluid, for example, from the linear hydraulic cylinder 70, to brake or slow down the linear hydraulic cylinder 70. Additionally, the independent metering valve 184A may be opened to divert the flow of hydraulic fluid back to the tank 108. The output conduit 214 allows hydraulic fluid to flow from the independent metering valve 184A through the output conduit 214 into the tank 108 to be used again by the pump 106. This provides for a regenerative supply or source of hydraulic fluid for the pump 106, and in this mode of operation the IMV circuit 102A is regenerative. These and other suitable control sequences may be controlled by the flow control module 220.

Figure 5:
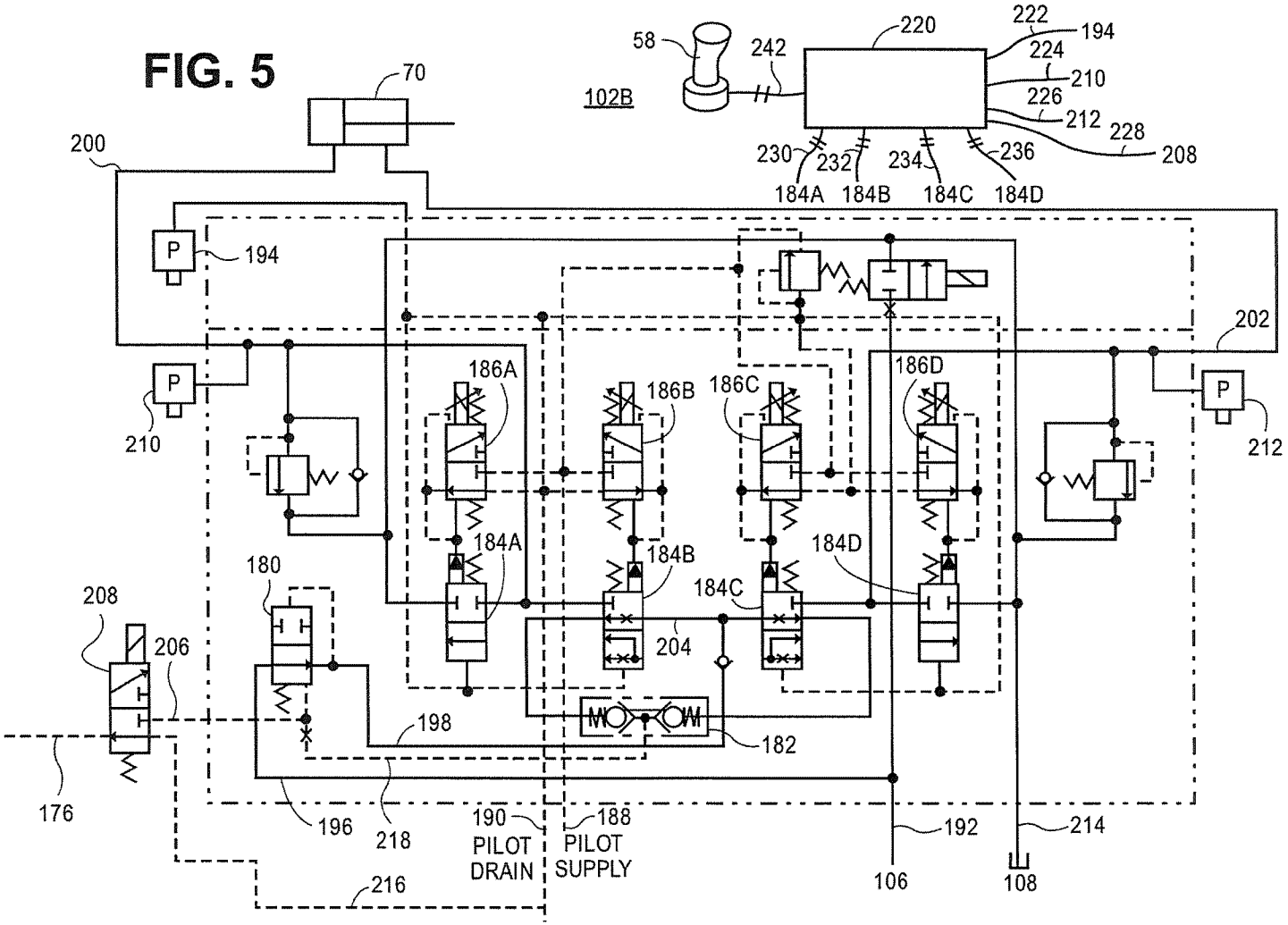
FIG. 5 shows a schematic view of an IMV circuit, according to an aspect of the disclosure.

FIG. 5 shows a schematic view of the IMV circuit 102B, according to an aspect of the disclosure. The IMV circuit 102B is similar to the IMV circuit 102A shown in FIG. 4 in many respects, and thus, for the sake of brevity, those elements described with reference to FIG. 4 will not be described again. As shown in FIG. 5, the IMV circuit 102B differs from the IMV circuit 102A in that the IMV resolver 182 provides a load-sense signal to the IMV pre-compensator 180 via a load-sense conduit 216. This load-sense signal is also provided to a load-sense communicator 208 via a load-sense conduit 206. The load-sense communicator 208 is electronically activated by the flow control module 220 in response to activation of the IMV circuit 102B. In response to activation, the load-sense communicator 208 opens to allow the load sense signal to proceed to the inverse resolver 170 (Shown in FIG. 3) via the load-sense outlet conduit 174. In this manner, the IMV circuit 102B can be configured to flowshare with the hydraulic system 100 that lacks an adaptive control system (ACS).

Figure 6:
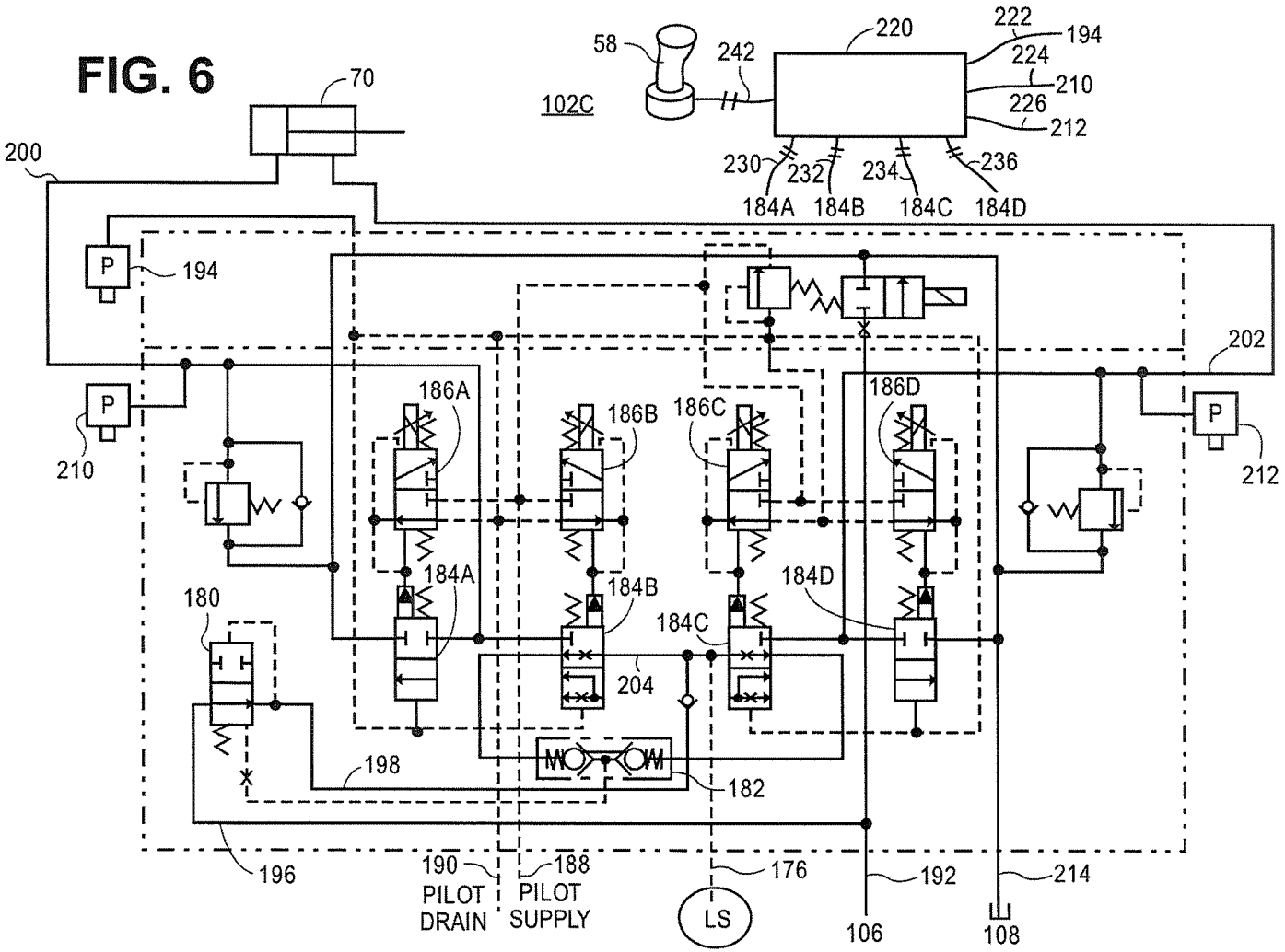
FIG. 6 shows a schematic view of an IMV circuit, according to an aspect of the disclosure.

FIG. 6 shows a schematic view of the IMV circuit 102C, according to an aspect of the disclosure. The IMV circuit 102C is similar to the IMV circuits 102A and 102B shown in FIGS. 4 and 5 in many respects, and thus, for the sake of brevity, those elements described with reference to FIGS. 4 and 5 will not be described again. As shown in FIG. 6, the IMV circuit 102C differs from the IMV circuits 102A and 102B in that the load-sense outlet conduit 174 is connected to the supply conduit 204 downstream of the IMV pre-compensator 180 and the load-sense signal to the inverse resolver 170 is provided via the load-sense outlet conduit 174. The IMV resolver 182 provides a load-sense signal to the IMV pre-compensator 180 via a load-sense outlet conduit 178. In this manner, the IMV circuit 102C can be configured to flowshare with the hydraulic system 100 that lacks an ACS and pre-compensation circuit.

INDUSTRIAL APPLICABILITY

The present disclosure may be applicable to any machine in which an independent metering valve (IMV) circuit is combined in a flowsharing arrangement with a load-sense hydraulic system. Aspects of the disclosed hydraulic system and method may promote increased functionality, operationally flexibility, performance, and energy efficiency of hydraulic systems.

According to an aspect of the disclosure, with reference to FIGS. 1 and 3, the machine 10 is a power shovel or an excavator, and the load-sense circuits 104A-104C control the movement of the various components of the machine 10. Adding an IMV circuit to the machine 10 may benefit the machine 10 in terms of improved hydraulic flow utilization, regenerative breaking, improved velocity control, reduced overspeed, and the like.

In order to add the IMV circuit 102 in a flowsharing manner, and thus remove the need to add a separate hydraulic pump, tank, and the like for the IMV circuit 102, flow characteristics between the existing load-sense circuits 104A-104C and the newly added IMV circuit 102 must be resolved. In order to perform this resolution, the inverse resolver 170 (Shown in FIG. 3) is added to the hydraulic system 100. The inverse resolver 170 receives the load-sense pressure signal from the system resolver 160 via a load-sense conduit 164 that is configured to convey the load-sense pressure signal from a load-sense duplicator 154. The inverse resolver 170 receives the load-sense pressure signal from the IMV circuit 102 via the load-sense outlet conduit 174 and, in response to these two load-sense signals, the inverse resolver 170 outputs a resolved load-sense pressure signal that is the lower of the input pressures, via a load-sense conduit 166, that is conditioned by the signal conditioning element 172 and then conveyed via a load-sense conduit 168 to the pump 106. In such a configuration if any of the load-sense circuits 104A-104C or the IMV circuit 102 generate an induced load across their respective circuits, a proportional load-sense signal pressure is relayed to the variable flow controller 162 of the pump 106 to modulate the pump 106 accordingly. During operation of machine 10, shown in FIG. 1, an operator located within operator station 22 may command a particular motion of the work tool 42 in a desired direction and at a desired velocity by way of the operator interface device 58.

Each of the IMV circuits 102A to 102C provide a novel and inventive example of how the capabilities of a load-sense hydraulic system can be improved upon by the flowsharing integration of an IMV circuit. Each of the IMV circuits 102A to 102C have modifications in order to integrate with particular variations in the load-sense circuitry. For example, the IMV circuit 102A is configured for integration into the hydraulic system 100 that includes the load-sense supply conduit 176 to output a load-sense signal, the load-sense conduit 168 to receive a load-sense signal, and the hydraulic system 100 includes elements such as the post-compensation valve 136 to compensate the flow of hydraulic fluid in response to the load-sense signal. In the example shown in FIG. 5, the IMV circuit 102B is configured to provide for flowsharing integration into the hydraulic system 100 that does not include the load-sense supply conduit 176 to output a load-sense signal. In this example shown in FIG. 5, the IMV resolver 182 is configured to provide the load-sense signal to both the IMV pre-compensator 180 and the inverse resolver 170 (Shown in FIG. 3) via the load-sense outlet conduit 174. In the example shown in FIG. 6, the IMV circuit 102C is configured to provide for flowsharing integration into the hydraulic system 100 that does not include pre-compensation of the load-sense circuits 104A-104C. In this example shown in FIG. 6, the load-sense signal provided to the hydraulic system 100 via the load-sense outlet conduit 174 is provided at a supply pressure downstream of the IMV pre-compensator 180 rather than an induced pressure that is resolved by the IMV resolver 182. Collectively, by including the appropriate IMV circuit 102A-C, shown in FIGS. 4-6, to the hydraulic system 100, the operator is provided with improved functionality of the implement controlled by the IMV circuit 102. Accordingly, this improved functionality can be provided while maintaining the existing pumps, pressure accumulators, and the like. In this manner, the cost outlay for the improved functionality of the IMV circuit 102 may be minimized. In addition some hydraulic circuits may benefit more from having an IMV circuit than other hydraulic circuits. By having a mixed flowsharing hydraulic system with both load sensing and IMV circuits, those hydraulic circuits benefiting most from being IMV circuits may benefit from this control method while less demanding circuits may use less expensive non-IMV circuits According to an aspect of the disclosure, the inverse resolver 170 and the signal conditioning element 172 are included in a kit to be added to a machine 10. Further, such a kit may also include the IMV circuit 102, corresponding control structures or software that compose, at least in part, the flow control module 220. According to another aspect of the disclosure, a kit including the inverse resolver 170, the signal conditioning element 172, the IMV circuit 102, corresponding control structures or software that compose, at least in part, the flow control module 220, or combinations thereof, are installed on a machine 10.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Throughout the disclosure, like reference numbers refer to similar elements herein, unless otherwise specified.

We claim:

1. A hydraulic system, comprising:

a first pump configured to generate a flow of a hydraulic fluid;

a variable flow controller configured to control a flow rate of the first pump in response to a first pressure signal;

a load-sense circuit fluidly coupled to the first pump, the load-sense circuit including:

a first actuator; and a first control valve fluidly coupled to the first actuator and configured to control a flow of the hydraulic fluid to the first actuator, the first control valve having a signal port fluidly coupled to the variable flow controller and configured to generate a second pressure signal;

an independent metering valve circuit fluidly coupled to the first pump and configured to generate a third pressure signal, the independent metering valve circuit including:

a second actuator;

a set of independent metering valves fluidly coupled to the second actuator and configured to independently control the flow of the hydraulic fluid to the second actuator; and an independent metering valve pre-compensator configured to control the flow of the hydraulic fluid to the set of independent metering valves;

an inverse resolver configured to receive the second pressure signal and the third pressure signal and output a fourth pressure signal; and a signal conditioning element configured to receive the fourth pressure signal and output the first pressure signal.

2. The hydraulic system according to claim 1, further comprising:

a first independent metering valve circuit resolver configured to receive a pump-to-cylinder pressure signal and a cylinder-to-tank pressure signal and output the third pressure signal.

3. The hydraulic system according to claim 2, further comprising:

a load-sense communicator valve configured to receive the third pressure signal from the first independent metering valve circuit resolver and output the third pressure signal to the inverse resolver in response to the independent metering valve circuit being activated, the load-sense communicator valve being configured to stop the output of the third pressure signal to the inverse resolver in response to the independent metering valve circuit being de-activated, wherein the independent metering valve pre-compensator is configured to control the flow of the hydraulic fluid to the set of independent metering valves in response to the third pressure signal.

4. The hydraulic system according to claim 1, further comprising a second independent metering valve circuit resolver configured to receive a pump-to-cylinder pressure signal and a cylinder-to-tank pressure signal and output a fifth pressure signal, wherein the independent metering valve pre-compensator is configured to control the flow of the hydraulic fluid to the set of independent metering valves in response to the fifth pressure signal, and wherein the third pressure signal is equal to a pressure of the hydraulic fluid downstream of the independent metering valve pre-compensator.

5. The hydraulic system according to claim 1, further comprising a set of pilot operated proportional valves having a respective pilot operated proportional valve for each independent metering valve of the set of independent metering valves.

6. The hydraulic system according to claim 1, further comprising a controller to control the load-sense circuit and the independent metering valve circuit.

7. The hydraulic system according to claim 6, further comprising a set of pressure sensors in communication with the controller, the set of pressure sensors being configured to sense a pressure of the hydraulic fluid at a first side of the second actuator, a second side of the second actuator, and a pressure of a pilot supply.

8. The hydraulic system according to claim 1, further comprising a plurality of load-sense circuits fluidly coupled to the first pump.

9. The hydraulic system according to claim 1, further comprising a plurality of independent metering valve circuits fluidly coupled to the first pump.

10. An independent metering valve circuit, comprising:

an actuator;

a set of independent metering valves fluidly coupled to the actuator and configured to independently control a flow of a hydraulic fluid to the actuator; and an independent metering valve pre-compensator configured to control a flow of the hydraulic fluid to the set of independent metering valves;

an inverse resolver configured to receive a first pressure signal from the independent metering valve circuit and a second pressure signal from a load-sense hydraulic system and output a third pressure signal; and a signal conditioning element configured to receive the third pressure signal and output a fourth pressure signal configured to control a pump fluidly coupled to the load-sense hydraulic system and the independent metering valve circuit.

11. The independent metering valve circuit according to claim 10, further comprising a first independent metering valve circuit resolver configured to receive a pump-to-cylinder pressure signal and a cylinder-to-tank pressure signal and output the first pressure signal.

12. The independent metering valve circuit according to claim 11, further comprising:

a load-sense communicator valve configured to receive the first pressure signal from the first independent metering valve circuit resolver and output the first pressure signal to the inverse resolver in response to the independent metering valve circuit being activated, the load-sense communicator valve being configured to stop the output the first pressure signal to the inverse resolver in response to the independent metering valve circuit being de-activated, wherein the independent metering valve pre-compensator is configured to control the flow of the hydraulic fluid to the set of independent metering valves in response to the first pressure signal.

13. The independent metering valve circuit according to claim 10, further comprising a second independent metering valve circuit resolver configured to receive a pump-to-cylinder pressure signal and a cylinder-to-tank pressure signal and output a fifth pressure signal, wherein the independent metering valve pre-compensator is configured to control the flow of the hydraulic fluid to the set of independent metering valves in response to the fifth pressure signal, and wherein the first pressure signal is equal to a pressure of the hydraulic fluid downstream of the independent metering valve pre-compensator.

14. The independent metering valve circuit according to claim 10, further comprising a set of pilot operated proportional valves having a respective pilot operated proportional valve for each independent metering valve of the set of independent metering valves.

15. The independent metering valve circuit according to claim 10, further comprising a controller to control the load-sense hydraulic system and the independent metering valve circuit.

16. The independent metering valve circuit according to claim 15, further comprising a set of pressure sensors in communication with the controller, the set of pressure sensors being configured to sense the pressure of the hydraulic fluid at a first side of the actuator, a second side of the actuator, and a pressure of a pilot supply.

17. A method for integrating an independent metering valve circuit in a load-sense hydraulic system, the method comprising the steps of:

installing an inverse resolver in the load-sense hydraulic system, the inverse resolver being configured for receiving a first pressure signal from an independent metering valve circuit and a second pressure signal from a load-sense hydraulic system and outputting a third pressure signal;

installing a signal conditioning element in the load-sense hydraulic system, the signal conditioning element being configured for receiving the third pressure signal from the inverse resolver and outputting a forth pressure signal configured to control a pump fluidly coupled to the load-sense hydraulic system and the independent metering valve circuit; and installing the independent metering valve circuit in the load-sense hydraulic system, the independent metering valve circuit including:

an actuator;

a set of independent metering valves fluidly coupled to the actuator and configured to independently control a flow of a hydraulic fluid to the actuator; and an independent metering valve pre-compensator configured to control a flow of the hydraulic fluid to the set of independent metering valves.

18. The method according to claim 17, further comprising the step of generating the first pressure signal with a first independent metering valve circuit resolver configured to receive a pump-to-cylinder pressure signal and a cylinder-to-tank pressure signal and output the first pressure signal.

19. The method according to claim 18, further comprising the step of:

outputting the first pressure signal to the inverse resolver by controlling a load-sense communicator valve to open in response to the independent metering valve circuit being activated;

stopping the output of the first pressure signal to the inverse resolver by controlling a load-sense communicator valve to close in response to the independent metering valve circuit being de-activated; and controlling the flow of the hydraulic fluid to the set of independent metering valves with the independent metering valve pre-compensator in response to the first pressure signal.

20. The method according to claim 17, further comprising the steps of:

generating the first pressure signal with a line installed downstream of the independent metering valve pre-compensator;

generating the fifth pressure signal with a second independent metering valve circuit resolver configured to receive a pump-to-cylinder pressure signal and a cylinder-to-tank pressure signal and output the fifth pressure signal; and controlling the flow of the hydraulic fluid to the set of independent metering valves with the independent metering valve pre-compensator in response to the fifth pressure signal.

* * * * *